US009107454B2

(12) United States Patent
Rushforth et al.

(10) Patent No.: US 9,107,454 B2
(45) Date of Patent: Aug. 18, 2015

(54) SHEET FILTER MATERIALS WITH ADDITIVES

(75) Inventors: David Rushforth, London (GB); John Sampson, London (GB)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 0 days.

(21) Appl. No.: 13/518,331

(22) PCT Filed: Dec. 21, 2010

(86) PCT No.: PCT/GB2010/052169

§ 371 (c)(1), (2), (4) Date: Oct. 3, 2012

(87) PCT Pub. No.: WO2011/077138

PCT Pub. Date: Jun. 30, 2011

(65) Prior Publication Data

US 2013/0025611 A1 Jan. 31, 2013

(30) Foreign Application Priority Data

Dec. 21, 2009 (GB) ..... 0922253.0

(51) Int. Cl.

*A24D 3/10* (2006.01)
*A24D 3/14* (2006.01)
*A24D 3/16* (2006.01)

(52) U.S. Cl.

CPC .. *A24D 3/14* (2013.01); *A24D 3/10* (2013.01); *A24D 3/16* (2013.01)

(58) Field of Classification Search

None

See application file for complete search history.

(56) References Cited

U.S. PATENT DOCUMENTS

| | | | | | |
|---|---|---|---|---|---|
| 3,384,507 | A | * | 5/1968 | Godwin et al. | 427/240 |
| 3,393,684 | A | | 7/1968 | Touey et al. | |
| 3,417,759 | A | * | 12/1968 | Touey et al. | 131/341 |
| 3,451,887 | A | | 6/1969 | Touey et al. | |
| 3,551,256 | A | * | 12/1970 | Watson | 156/441 |
| 3,605,759 | A | | 9/1971 | Owens et al. | |
| 3,943,832 | A | * | 3/1976 | Sexstone | 493/42 |
| 5,465,739 | A | | 11/1995 | Perfetti et al. | |
| 5,724,997 | A | | 3/1998 | Smith et al. | |
| 6,062,228 | A | * | 5/2000 | Loercks et al. | 131/332 |
| 6,207,601 | B1 | | 3/2001 | Maurer et al. | |
| 6,776,168 | B1 | | 8/2004 | Teufel et al. | |
| 2005/0066984 | A1 | | 3/2005 | Crooks et al. | |

FOREIGN PATENT DOCUMENTS

| | | | |
|---|---|---|---|
| CN | 1409607 | A | 4/2003 |
| CN | 101094597 | A | 12/2007 |
| DE | 102005060972 | A1 | 6/2007 |
| GB | 1145484 | A | 3/1969 |
| GB | 1255657 | A | 12/1971 |
| GB | 1256808 | A | 12/1971 |
| GB | 1273418 | A | 5/1972 |
| GB | 2260477 | A | 4/1993 |
| GB | 2261152 | A | 12/1993 |
| JP | 6-502068 | | 3/1994 |
| JP | 11-279201 | | 10/1999 |
| JP | 2001-352963 | | 12/2001 |
| WO | 92/05713 | | 4/1992 |
| WO | 2006064371 | A1 | 6/2006 |
| WO | 2007/028476 | A2 | 3/2007 |
| WO | 2008/074977 | A1 | 6/2008 |
| WO | 2008/081338 | A2 | 7/2008 |
| WO | 2008/146548 | | 12/2008 |
| WO | 2008/150130 | A1 | 12/2008 |
| WO | 2009/037461 | A2 | 3/2009 |
| WO | 2010/136751 | A2 | 12/2010 |

OTHER PUBLICATIONS

Touey et al., "Selective Removal of Phenol From Cigarette Smoke with Filters of Cellulose Acetate", 1998, Tennessee Eastman Company. Accessed via: http://legacy.library.ucsf.edu/tid/hyg51f00 on Feb. 6, 2013.*

Office Action issued on Jun. 26, 2013 for Chinese Patent Application No. 201080064416.X, filed Dec. 21, 2010.

Search Report issued on Jun. 20, 2013 for Chinese Patent Application No. 201080064416.X, filed Dec. 21, 2010.

International Programme on Chemical Safety, International Chemical Safety Cards (ICSC) database, ICSC No. 1203 (Triethyl Citrate), Oct. 18, 1999 (Peer review status validated), Dec. 23, 2014 (downloaded from http://www.ilo.org/dyn/icsc/showcard.display?p_card_id=1350).

International Programme on Chemical Safety, International Chemical Safety Cards (ICSC) database, ICSC No. 1350 (Triacetin), Oct. 12, 2006 (Peer review status validated), Dec. 23, 2014 (downloaded from http://www.ilo.org/dyn/icsc/showcard.display?p_card_id=1203).

International Search Report and Written Opinion, mailed Apr. 12, 2011, for PCT International Application No. PCT/GB2010/052169, filed Dec. 21, 2010.

International Preliminary Report on Patentability, mailed May 16, 2012, for PCT International Application No. PCT/GB2010/052169, filed Dec. 21, 2010.

* cited by examiner

*Primary Examiner* — Michael J Felton
(74) *Attorney, Agent, or Firm* — N W Poulsen; D Tilahun

(57) ABSTRACT

The present invention relates to the inclusion of additives in a filter element comprising a non-woven sheet material or paper as the filter material to increase the selective removal of semi-volatile compounds and to improve the taste characteristics of the smoke drawn through the filter element. The increased selective removal of semi-volatile compounds from the smoke being drawn through the filter element is provided by polyethylene glycol. TEC and/or triacetin are additives which have been found to improve the taste characteristics of smoke drawn through the filter element.

14 Claims, 6 Drawing Sheets

SHEET FILTER MATERIALS WITH ADDITIVES

CLAIM FOR PRIORITY

This application is a National Stage Entry entitled to and hereby claims priority under 35 U.S.C. §§365 and 371 to corresponding PCT Application No. PCT/GB2010/052169, filed Dec. 21, 2010, which in turn claims priority to British Application Serial No. GB 0922253.0, filed Dec. 21, 2009. The entire contents of the aforementioned applications are herein expressly incorporated by reference.

DESCRIPTION

Figure 1A:
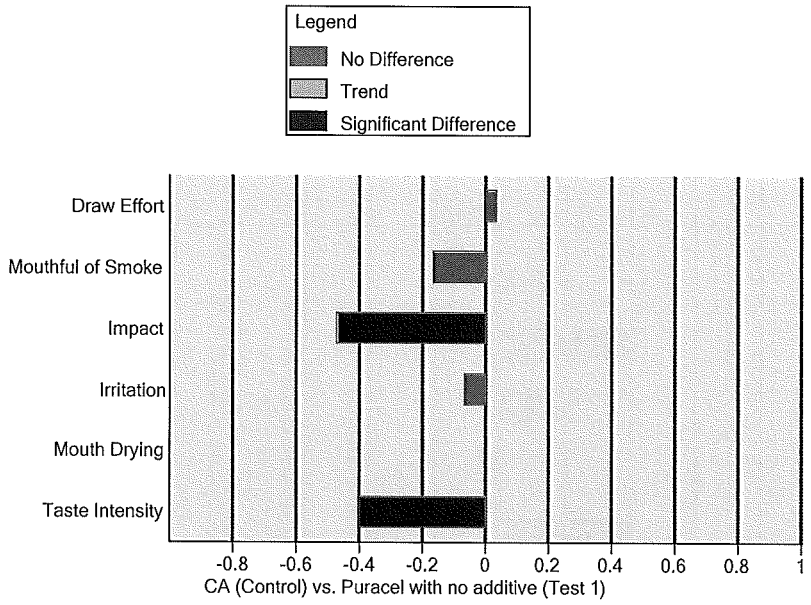
FIGS. 1A-1D provide results of an exemplary Descriptive Paired Comparison Test experiment for observed sensorial differences for tobacco products with cellulose acetate filters containing either no additive (FIG. 1A), 5% PEG 400 (FIG. 1B), 6% Triacetin (FIG. 1C), or 6% triethyl citrate (TEC) (FIG. 1D), according to some embodiments.

The present invention relates to a tobacco smoke filter element, a filter comprising the same and smoking articles comprising a filter and/or a filter element. More specifically, the invention relates to filter elements and/or filters comprising a non-woven sheet material or paper as the filter material, and including additives to improve both the filtration characteristics of the filter and the taste characteristics of the smoke. Suitable filter materials for use in the invention include, for example, paper, polyvinyl alcohol (PVOH) or polylactic acid (PLA).

As used herein, the term "smoking article" includes smokeable products such as cigarettes, cigars and cigarillos whether based on tobacco, tobacco derivatives, expanded tobacco, reconstituted tobacco or tobacco substitutes and also heat-not-burn products.

A wide variety of fibrous materials have been suggested as filters for cigarette smoke. Cellulose acetate tow is the most commonly used filter material. One disadvantage associated with this filter material is, however, that it is slow to degrade. Whilst most of the components of a spent smoking article dissociate into their individual constituent parts and degrade within a relatively short period of time when exposed to moisture and/or mechanical abrasion, cellulose acetate filter material is slow to degrade because the cellulose acetate fibres themselves are effectively not water soluble and therefore poorly biodegradable.

Non-woven sheet materials and paper may also be used as filter materials in smoking articles. For example, crepe paper (also referred to as crimped or gathered paper) has been used as filter material.

Non-woven sheet materials and paper are more readily biodegradable than the cellulose acetate. However, they currently have drawbacks when used as filter materials. In order to attain the desired structural rigidity when constructing a filter element from non-woven sheet materials and paper, the filter material must be very densely packed and this means that these filter elements have quite different properties to those made of cellulose acetate. They exhibit a greater resistance to the flow of smoke, resulting in a pressure drop which is higher than that of a conventional cellulose acetate filter, requiring the user to draw harder on the smoking article. Perhaps more significantly, the smoke drawn through such filter material has been found to have different taste characteristics compared to the smoke drawn through conventional cellulose acetate filter material. What is more, filter elements comprising non-woven sheet materials or paper as the filter material have been shown to exhibit significantly less selective removal of semi-volatile compounds than conventional cellulose acetate tow filter materials.

In light of the foregoing, at least one embodiment of the present invention provides a filter element which is more readily degradable than filter elements comprising a conventional cellulose acetate filter material, which exhibits good selective removal of semi-volatile compounds and which provides smoke having similar taste characteristics to that provided by conventional cellulose acetate filters.

It is known to use additives such as triacetin (glycerin triacetate), TEC (triethyl citrate) and PEG 400 (low molecular weight polyethylene glycol) in conventional cellulose acetate (CA) filters. These additives are plasticizers and they are used in CA filters to bind adjacent fibres, in order to give the filter rods sufficient hardness for cigarette manufacture and use. Plasticized cellulose acetate tow is also known to improve the selective removal of semi-volatile compounds found in smoke (e.g. phenol, o-cresol, p-cresol and m-cresol). For this effect, it appears to be necessary for the plasticizer to be present on the surface of the CA fibres.

Because of the fibre-binding effect of plasticizers, CA filters are generally disclosed as including less than 10% plasticizer. It has been found that including more plasticizer has a detrimental effect on the cellulose acetate tow, causing holes to be formed.

Whilst inclusion of plasticizers such as triacetin, TEC or PEG 400 in CA filters is relatively common, their inclusion in non-woven sheet and paper filter materials is less attractive. Firstly, the plasticizers are used in CA filters to bind fibres and the plasticizer would clearly not have this advantageous effect when added to non-woven sheet material or paper (in which the fibres are already bound within the sheet structure). Secondly, it has been suggested that triacetin and TEC do not particularly improve the selective removal of semi-volatile compounds when used in paper filter materials. Thirdly, these commonly used plasticizers are liquids and their application to non-woven sheet and paper filter materials will be limited as they will cause these materials to become soggy and to lose their structural integrity.

SUMMARY OF THE INVENTION

According to a first aspect of the present invention, a filter element is provided comprising filter material which is a non-woven sheet or paper material, and:

(i) polyethylene glycol in an amount sufficient to increase the selective removal of semi-volatile compounds from the smoke being drawn through the filter element;

(ii) TEC in an amount sufficient to improve the taste characteristics of smoke drawn through the filter element; and/or (iii) triacetin in an amount sufficient to improve the taste characteristics of smoke drawn through the filter element.

In a second aspect of the present invention, there is provided a filter comprising one or more filter elements according to the first aspect.

In a third aspect of the present invention, there is provided a smoking article comprising a filter element according to the first aspect and/or a filter according to the second aspect, attached to a rod of smokeable material. The smoking article may be a cigarette.

In a fourth aspect of the present invention, there is provided the use of polyethylene glycol, TEC and/or triacetin to improve the selective removal of semi-volatile compounds by a filter element comprising non-woven sheet or paper filter material and for improving the taste characteristics of the smoke drawn through said filter element.

DETAILED DESCRIPTION

The present invention relates to the inclusion of additives in a filter element comprising non-woven sheet or paper filter material to increase the selective removal of semi-volatile compounds from the smoke being drawn through the filter element, and to improve the taste characteristics of the smoke drawn through the filter element.

The selective removal of semi-volatile compounds is provided by the additive polyethylene glycol. TEC and/or triacetin are additives which have been found to improve the taste characteristics of smoke drawn through the filter element.

These additives allow the use of non-woven sheet or paper filter material to be fine-tuned, so that the performance of the filter element can more closely resemble that of a cellulose acetate filter element. The additives also give the use of these alternative filter materials much greater flexibility, widening the range of their applicability whilst retaining the beneficial biodegradable properties.

It has further been surprisingly found that the inclusion of the additives to the paper or non-woven sheet material has the added advantage of increasing the biodegradation of the filter element. Filter elements according to the present invention, which included one of the three additives PEG, TEC or triacetin, show significantly faster biodegradation when exposed to environmental conditions than an equivalent filter element without an additive.

Paper filter material usually comprises gathered, pleated, crimped, crepe or even shredded paper. Paper filter materials tend to have a low air permeability, exhibit a basic pH, and can be gathered or formed easily to form the filter element.

A preferred filter material for filter elements of the present invention is a gathered or pleated paper. Examples of suitable papers are Puracel™ and Myria™ papers (Filtrona plc, United Kingdom).

Other, non-woven sheet materials may be used as filter materials. Non-woven materials are broadly defined as sheet or web structures bonded together by entangling fibres or filaments mechanically, thermally or chemically, or by a combination of two or more of these. They tend to be flat, porous sheets that are made directly from separate fibers. They are not made by weaving or knitting and do not require converting the fibers to yarn. The non-woven sheet materials used in the present invention are preferably ones which are readily biodegradable. Examples of materials include polyvinyl alcohol (PVOH), polylactic acid or polylactide (PLA), poly(ε-caprolactone) (PCL), poly(1-4 butanediol succunate) (PBS) and poly(butylene adipate-co-terephthalate) (PBAT). Other suitable filter materials include starch fibres and calcium alginate.

In a preferred embodiment, the filter material of the present invention includes PEG and triacetin or it includes PEG and TEC. More preferably, the filter material includes PEG, triacetin and TEC.

In a preferred embodiment of the invention, the polyethylene glycol is a high molecular weight polyethylene glycol, preferably one which is solid at room temperature. Such polyethylene glycols include PEG 600 and higher, and preferably PEG 1000 and higher. These particular polyethylene glycols are favoured as they are solid (or semi-solid) at room temperature and so their addition will not compromise the structural integrity of the non-woven sheet or paper filter material. Additives which are liquid at room temperature can adversely affect the structural integrity and strength of a filter element where the filter material is paper or a non-woven sheet material and for that reason there will be a limit on the amount of such additives which can be included whilst still retaining the required rigidity and strength of the filter element.

Indeed, rather than weakening the non-woven sheet or paper filter material, the use of a high molecular weight polyethylene glycol has the further advantage that it can actually increase the structural integrity and rigidity of the filter material, so that it may be possible to use less of the filter material in the filter element. This provides further flexibility when forming the filter element with regard to the amount of filter material required to achieve the desired hardness and rigidity. This in turn would allow the manufacturer to adjust the pressure drop of the filter element. This would allow a filter element according to the present invention to be designed having properties which closely resemble those of conventional CA filter elements.

In addition, the selective removal of semi-volatile compounds provided by the addition of the PEG to the filter element is proportional to the amount of PEG included. The flexibility to add greater amounts of PEG, especially high molecular weight PEG, means that the ability of the filter element to selectively remove semi-volatile compounds may easily be adjusted to a desirable level.

As PEG is water-soluble, its inclusion in the filter elements should not adversely affect the biodegradation of the product. Indeed, it has been surprisingly found that the addition of PEG to a filter element comprising a non-woven sheet material or paper as the filter material actually enhances biodegradation. This phenomenon is discussed in greater detail below.

In one embodiment of the present invention, the PEG is included in or on the filter material of the filter element in an amount of up to 30%, preferably up to 20%, and more preferably of 5-10% by weight of the filter element. These figures are determined by comparing the dry weight of the filter element without the PEG (comprising the filter material and paper wrapper) to the weight of the filter element including the PEG additive.

The addition of TEC and/or triacetin has a different effect on the filter material of the filter elements of the present invention. These additives have been surprisingly found to have a beneficial effect on the taste and odour of the smoke which is drawn through the filter element. A common criticism of paper filter elements is that they tend to produce poor tasting smoke. The triacetin and TEC have different effects on the smoke's taste characteristics and the two additives may be added in differing amounts in order to produce a desirable smoke taste profile.

In conventional cellulose acetate filter material, the amount of triacetin or TEC which can be included is limited by the effect that these additives have on binding the fibres of the fibrous material, with amounts of triacetin exceeding about 7% causing holes to be formed in the cellulose acetate material. In contrast, the amount of TEC and triacetin which may be included in or on the filter material of the present invention is not limited. Indeed, where PEG is also included which is solid at room temperature, the effect of these liquid additives in making the filter material soggy is minimised and up to 30% by weight of TEC and/or triacetin may be included, although amounts of up to 20% or up to about 12% by weight of the filter element are preferred. These figures are determined by comparing the dry weight of the filter element without the additive (comprising the filter material and paper wrapper) to the weight of the filter element including the additive.

According to one advantageous embodiment of the present invention, the filter element comprises a combination of both TEC and triacetin.

In a preferred embodiment, the sheet filter material is not coated with cellulose acetate fibres. Preferably, the filter material and/or the filter element do not include any cellulose acetate.

If desired, further additives can be incorporated into or onto the filter material, including tobacco extracts, glycerine, menthol, carbon fibres, carbon particles, and the like. Such additives can be incorporated into the sheet material during its manufacture, or applied to the material after manufacture is complete.

Preferred filter materials comprise paper or non-woven sheet materials having a thickness greater than about 0.05 mm, preferably from about 0.06 mm to about 0.08 mm. The paper filter materials may comprise paper having a basis weight of about 15 $g/m^2$ to about 40 $g/m^2$, preferably about 20 $g/m^2$ to about 35 $g/m^2$.

In an embodiment of the present invention, the filter element has a longitudinally extending core comprising the filter material, and a wrapper which surrounds the core. The wrapper of the filter element is preferably a paper wrapper. In one embodiment the wrapper is conventional plugwrap.

The wrapper for use in the filter element of the present invention may be porous or non-porous. The wrapper for use in the filter element may be ventilated or unventilated.

In one embodiment the wrapper may be a conventional plugwrap which covers 360° of the core, in which case the plugwrap has a lapped and stuck seam holding the wrapper around the core. Where an adhesive is used to hold the wrapper in place, the adhesive is preferably one which is water-dispersible.

In another embodiment the wrapper (in particular plugwrap) preferably does not extend 360° around the core. In other words, in one embodiment preferably the wrapper is a split wrapper. A split wrapper is one which extends circumferentially about the core, but extends less than 360° around the circumference of the core. In such an embodiment, there is no lapped and stuck seam holding the wrapper around the core. Instead, the split wrapper may be held in place by other known means, such as by bonding the wrapper directly to the core for instance.

In one embodiment, the filter element according to the present invention further comprises particulate material. Preferably the particulate material includes sorbents (e.g. selected from activated carbon, charcoal, silica gel, sepiolite, alumina, ion exchange material etc.), pH modifiers (e.g. alkaline materials such as $Na_2CO_3$, acidic materials), flavourants, other solid additives and mixtures thereof.

Advantageously the particulate material is selected from a group of relatively high surface area materials capable of adsorbing smoke constituents without a high degree of specificity. Suitable general adsorbents can be selected from the group consisting of carbon, activated carbon, activated charcoal, activated coconut carbon, activated coal-based carbon or charcoal, zeolite, silica gel, meerschaum, aluminium oxide (activated or not), carbonaceous resin or combinations thereof.

In one embodiment, the particulate material used herein is carbon, for instance activated carbon, or charcoal or other absorbent material. In one embodiment, preferably the activated carbon is activated coconut carbon.

Any particulate material used may be a single substance or a mixture, and/or may be in admixture with other material.

The particulate material may be interspersed throughout the core of filter material. Alternatively, the particulate material may be interspersed in some parts (but not all) of the core. The parts may be evenly or unevenly distributed.

The particulate material may extend over the full longitudinal length of the core. Alternatively, the particulate material may extend from one end of the core to a section that is short of the other end. Alternatively, the particulate material may be present in discrete areas that need not extend from—or be present at—any end of the core. Different areas may have different loadings of particulate material and/or different types of particulate material.

Another option for including particulate material in a filter element is to adhere the particles to a wrapper surrounding the filter element. GB 2260477 and GB 2261152 describe various configurations of additive adhesion. In an embodiment of the present invention, the wrapper of the filter element comprises a particulate material adhered to one or more portions of said wrapper. Preferably, the particulate material is adhered to two or more portions of the wrapper, the portions being circumferentially spaced from one another and at least one of said two or more portions extending over the full longitudinal length of said wrapper.

In some embodiments, in addition to having adsorbent particulate material adhered to the wrapper, the core may further comprise particulate material interspersed in the paper filter material. The particulate material of the core may be the same as the particulate material adhered to the wrapper. Alternatively, the particulate material of the core may be different from the particulate material adhered to the wrapper.

The particulate material in the core may be homogeneous—in the sense that it is made up of substantially the same component (for some embodiments, preferably all of the same). Alternatively, the particulate material in the core may be heterogeneous—in the sense that it is made up of two or more different components.

The particulate material may be adhered to the wrapper and/or to the paper filter material by hot melt adhesive (e.g. various polyester adhesives), high melting point polyethylene glycol, or emulsion-type adhesive such as PVA.

The particulate material may be directly or indirectly adhered to the wrapper and/or to the sheet filter material. An example of direct adherence is wherein the particulate material is affixed to the sheet filter material and/or wrapper (such as the inner surface thereof) by means of a suitable adhesive. An example of indirect adherence is wherein the particulate material is affixed to an intermediate layer (which may be made of paper or other suitable support matrix—such as a textile material—or combinations thereof) by means of a suitable adhesive and wherein the intermediate layer is affixed to the filter material and/or wrapper (such as the inner surface thereof) by means of a suitable adhesive.

Some filter elements according to the invention may exhibit a pressure drop of greater than about 40 mm of water at an airflow rate of 17.5 $cm^3/s$ per 0.1 g of filter material. They also preferably exhibit a filtration efficiency for particulate matter of mainstream tobacco smoke of less than about 15% per 0.1 gram of filter material.

Filters according to the present invention comprise one or more of the filter elements according to the first aspect of the invention.

In one embodiment the filter element may be the sole filter element in the filter when formed into a smoking article rod.

In another embodiment the filter element may be part of a larger filter. In other words, the filter element may be part of a composite or multi-component filter. Suitably the filter elements of the composite filter are arranged longitudinally of one another with the end of each filter element abutting the next. Suitably the composite filter may have 2, 3, 4 or more distinct or discrete sections. However, filters according to the present invention may be of integral construction but have the general appearance of a composite filter. In one embodiment the filter is a triple-filter with three sections. In another embodiment the filter is a dual-filter with two sections.

In the composite filter suitably there may be one or more filter elements according to the present invention. Where there is more than one filter element according to the present invention in the composite filter, suitably the filter elements may be positioned longitudinally next to one another or be separated by another filter element.

Where the filter element is used in a composite filter, suitably the one or more other sections of the composite filter may comprise a biodegradable filter material, such as crepe, crimped or gathered paper material. The one or mote other sections may optionally comprise one or more additives, such as adsorbent or flavouring materials.

In a yet further alternative, the composite filter may comprise a section which forms a cavity containing granular material.

Suitably, filter elements having particular pressure drop characteristics, such as the filter sold by Filtrona and known as The Ratio Filter, may also be utilised.

In addition, the pressure drop and/or mechanical filtration efficiency of the filter plug sections can be selected to achieve the desired smoking mechanics and filtration characteristics as may be required with the specific product design desired.

In a composite filter arrangement the pressure drop of the filtration material plugs/sections may be varied.

A portion of the filter element and/or the composite filter comprising said filter element may comprise a catalyst. Advantageously the catalyst facilitates the conversion of carbon monoxide (CO) to carbon dioxide (COO in the vapour phase of the smoke. It is much by preference that the catalyst is highly selective for carbon monoxide. Preferably the catalyst may be one of the group consisting of transition metal oxides, silica, alumina, zeolites, impregnated carbon, for example, carbon impregnated with metals.

In some embodiments of the invention, the tobacco-rod end portion of the composite filter may be a cavity containing an adsorbent and/or catalyst or, alternatively, may comprise a smoke filtration material having an adsorbent and/or catalyst dispersed therein. Advantageously the adsorbent is capable of retaining at least a portion of the vapour phase of smoke.

Smoking articles of the present invention comprise a filter element according to the first aspect and/or a filter according to the second aspect attached to a rod comprising a smokeable fillet material (e.g. tobacco). The smoking article may be a cigarette.

The filter element and/or filter comprising said filter element may be attached to a wrapped smokeable fillet material rod (i.e. a wrapped tobacco rod, for instance) by conventional tipping overwrap to form a smoking article. The tipping overwrap may be ventilating or non-ventilating overwrap.

Suitably, the smokeable filler material may be tobacco material or a tobacco substitute material. Preferably the smokeable material is a tobacco material. Suitably the tobacco material comprises one or more of stem, lamina, and tobacco dust. It is preferred that the tobacco material comprises one or more of the following types: Virginia or flue-cured tobacco, Burley tobacco, Oriental tobacco, reconstituted tobacco. It is much by preference that the smokeable material comprises a blend of tobacco material. Advantageously the smokeable material comprises 10-80% Virginia tobacco, 10-60% Burley tobacco, 0-20% Oriental tobacco, 0-120% reconstituted tobacco and 0-30% expanded tobacco.

The smoking material of smoking articles comprising a filter element according to the subject invention and/or filter comprising a filter element according to the subject invention preferably comprises or consists of cut tobacco, a proportion of which tobacco may be expanded tobacco. The smoking material may comprise reconstituted tobacco or tobacco substitute material.

The smokeable filler material may also comprise one or more of the following: burn additive, ash improver, inorganic filler material, organic fillet, aerosol generating means, binder, flavouring and/or colouring agents.

EXAMPLE 1

The objective of this experiment was to determine whether there are any sensorial differences between a control cellulose acetate filter and four test samples.

Control: Cellulose acetate filter
Test 1: Puracel™ with no additive
Test 2: Puracel™ with 5% PEG400
Test 3: Puracel™ with 6% Triacetin
Test 4: Puracel™ with 6% TEC Methodology The products used within this test were smoked between 28 and 29 Sep. 2009. Two Descriptive Paired Comparison Tests were carried out by 15-16 panellists for each sample. Coded cigarettes were used and the significance of any difference was assessed using the Binominal test.

The attributes that were considered during this test were: 1) Draw Effort, 2) Mouthful of Smoke, 3) Irritation, 4) Impact, 5) Mouth Drying and 6) Taste Intensity.

Results

CA (Control) vs Puracel™ with no additive (Test 1)—see FIG. 1A. It was found that for Impact and for Taste Intensity there was a statistically significant difference between the control and the test sample (at a 5% significance level). The Test 1 sample was considered to perform worse than the control in connection with these two attributes.

Figure 1B:
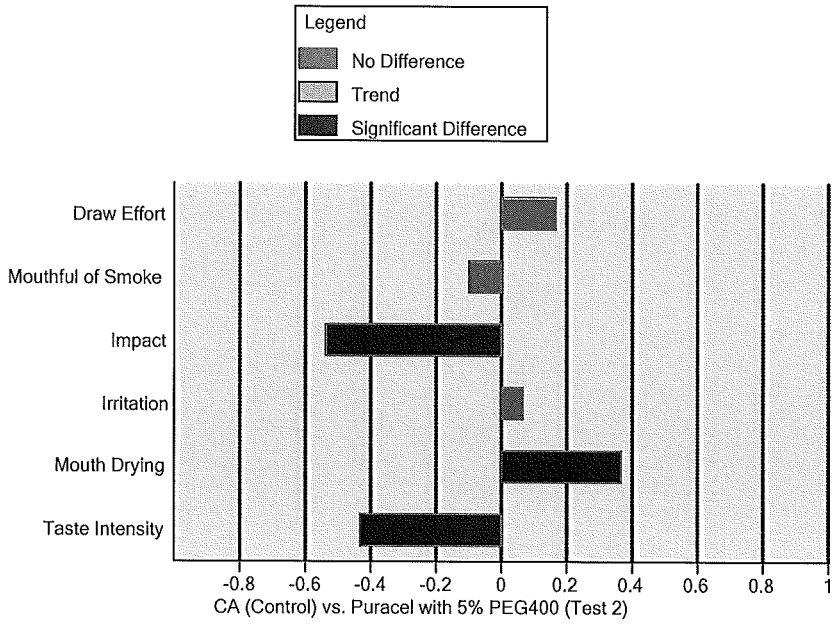

CA (Control) vs Puracel™ with 5% PEG400 (Test 2)—see FIG. 1B. It was found that for Impact, Mouth Drying and Taste Intensity there is a statistically significant difference at a 5% significance level between the control and the Test 2 sample. The Test 2 sample was considered to perform worse than the control in connection with these three attributes.

Figure 1C:
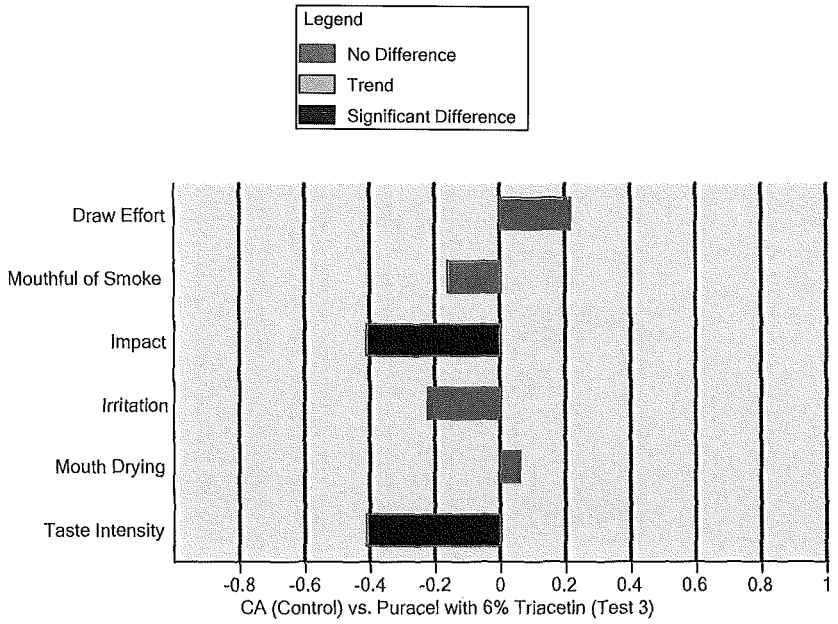

CA (Control) vs. Puracel™ with 6% Triacetin (Test 3)—see FIG. 1C. It was found that for Impact and for Taste Intensity there was a statistically significant difference between the control and the test sample (at a 5% significance level). The Test 3 sample was considered to perform worse than the control in connection with these two attributes.

Figure 1D:
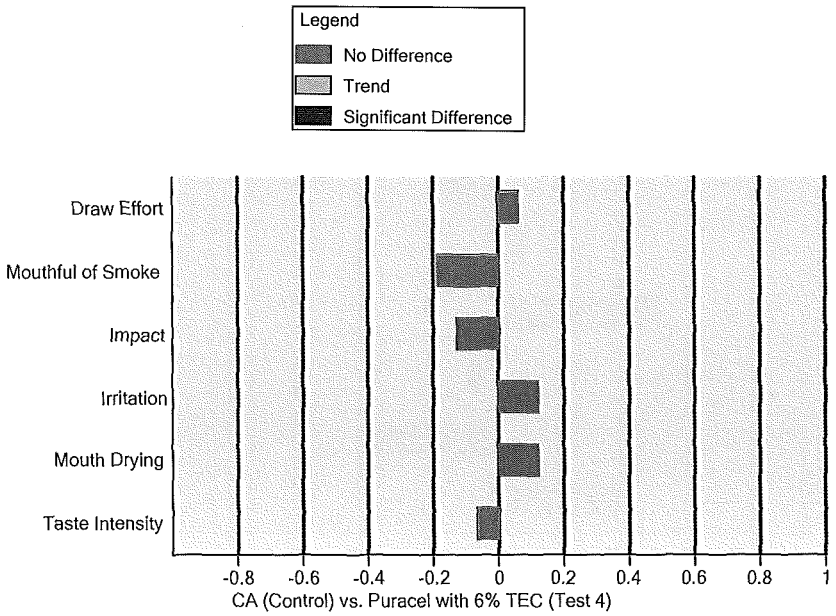

CA (Control) vs. Puracel™ with 6% TEC (Test 4)—see FIG. 1D. The results showed no statistically significant difference at a 5% significance level for any of the attributes tested.

Conclusion

The results show that there were statistically significant differences between the CA control filter and three of the four the Puracel™, paper-based filters tested.

The test samples including Puracel™ with no additive and Puracel™ with 6% triacetin exhibited very similar differences to the CA control. Both test samples were rated as being significantly lower on Impact and Taste Intensity. The test sample including Puracel™ with 5% PEG400 had a similar difference, with Impact and Taste Intensity being significantly lower than the control, but also suffered from significantly higher Mouth Drying than the control.

Puracel™ with 6% TEC appears to be the sample that has the most similar sensorial characteristics to the CA control filter.

EXAMPLE 2

The objective of this set of experiments was to determine if there are any sensorial differences between so-called "Parisienne" cellulose acetate control filter and 7 further test samples Control: CA Control Test 1 Puracel™ with 0% Plasticiser Test 2 Puracel™ with 9% TEC Test 3 Puracel™ with 9% TA Test 4 Puracel™ with 4.5% TEC, 4.5% PEG Test 5 Puracel™ with 4.5% TEC, 4.5% TA Test 6 Puracel™ with 4.5% TA, 4.5% PEG 400

Test 7 Puracel™ with 3% TEC, 3% PEG 400, 3% TA

Methodology

The products used within this test were smoked between 29 June and 1 July, and on 6 Jul. 2010. A Descriptive Paired Comparison Test was carried out by 20 panellists for each sample. Coded cigarettes were used and the significance of any difference was assessed using the Binominal test.

The attributes used during this test were: 1) Draw Effort, 2) Mouthful of Smoke, 3) Impact, 4) Irritation, 5) Mouth Drying and 6) Taste Intensity.

Results

Figure 2A:
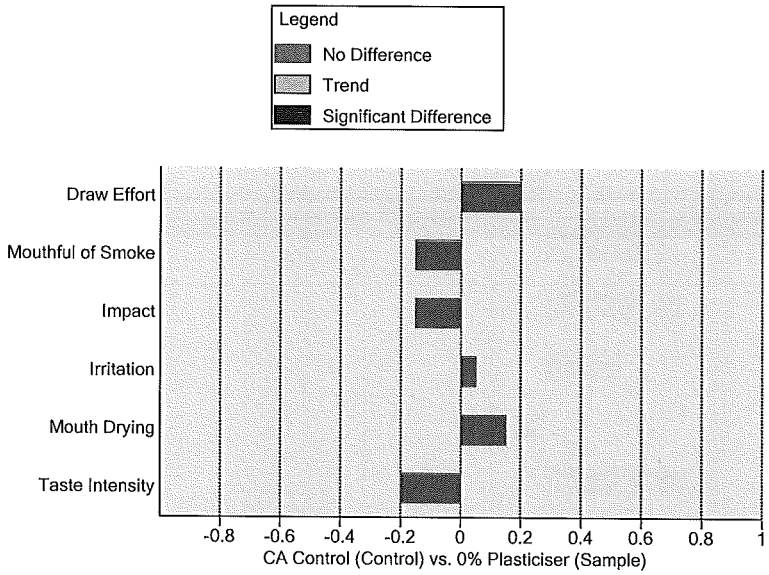
FIGS. 2A-2G provide results of an exemplary Descriptive Paired Comparison Test experiment for observed sensorial differences for tobacco products with so-called "Parisienne" filters containing either no plasticizer (FIG. 2A), 9% TEC (FIG. 2B), 9% Triacetin (FIG. 2C), 4.5% TEC and 4.5% PEG (FIG. 2D), 4.5% TEC and 4.5% Triacetin (FIG. 2E), 4.5% PEG 400 and 4.5% Triacetin (FIG. 2F), or 3% TEC, 3% PEG 400 and 3% Triacetin (FIG. 2G), according to some embodiments.

CA Control (Control 1) vs. Puracel™ with 0% Plasticiser (Test 1)—see FIG. 2A. It was found that there was not enough evidence to show a statistically significant difference between the control and the test sample (at a 5% significance level) in connection with any of the 6 attributes.

Figure 2B:
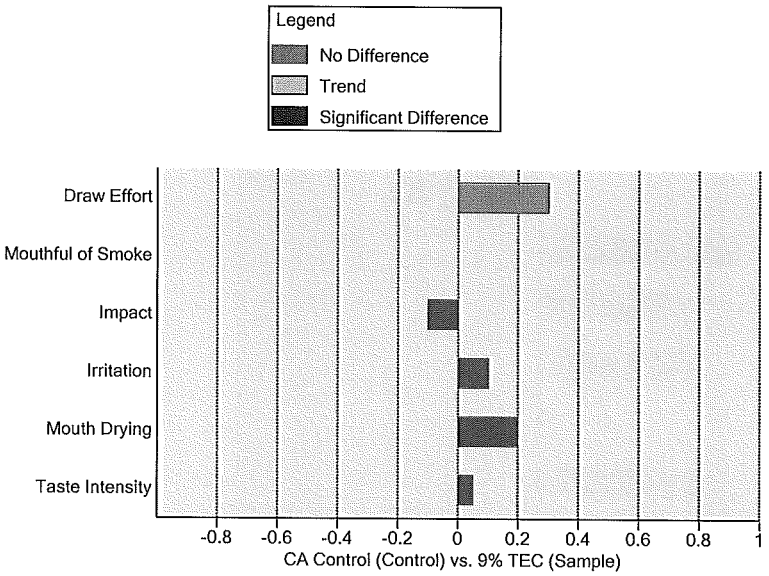

CA Control (Control 1) vs. Puracel™ with 9% TEC (Test 2)—see FIG. 2B. There is not enough evidence to show a statistically significant difference between the control and the test sample in terms of Draw Effort (at a 5% significance level), although there was some evidence at a 10% significance level.

Figure 2C:
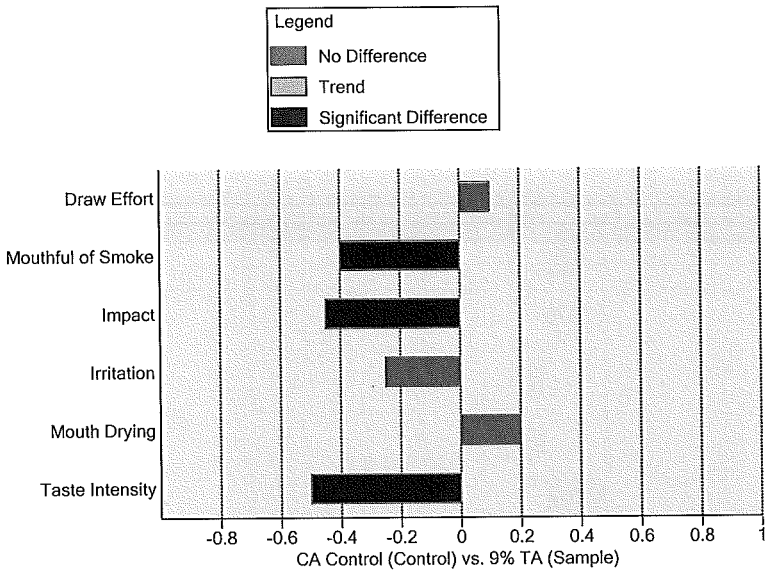

CA Control (Control 1) vs. Puracel™ with 9% TA (Test 3)—see FIG. 2C. There was a statistically significant difference between the control and the test sample in terms of Mouthful of Smoke, Impact and Taste Intensity (at a 5% significance level).

Figure 2D:
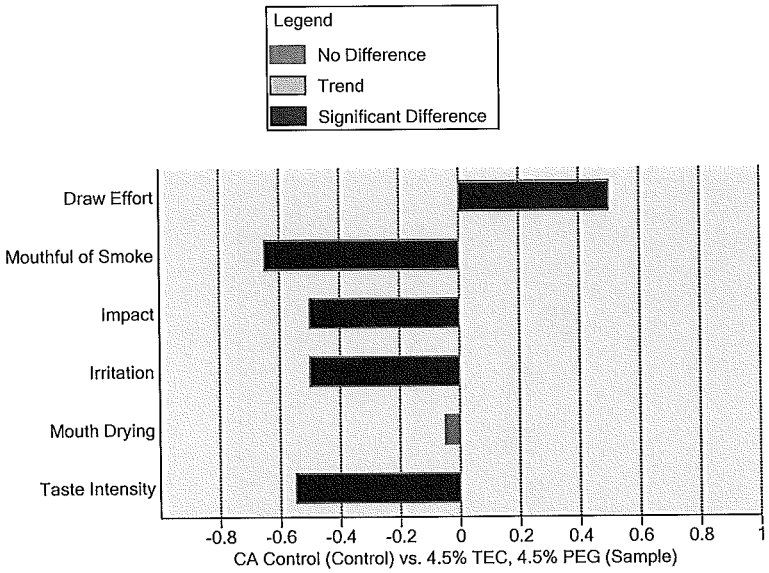

CA Control (Control 1) vs. Puracel™ with 4.5% TEC, 4.5% PEG (Test 4)—see FIG. 2D There was a statistically significant difference between the control and the test sample in terms of Draw Effort, Mouthful of Smoke, Impact, Irritation and Taste Intensity (at a 5% significance level).

Figure 2E:
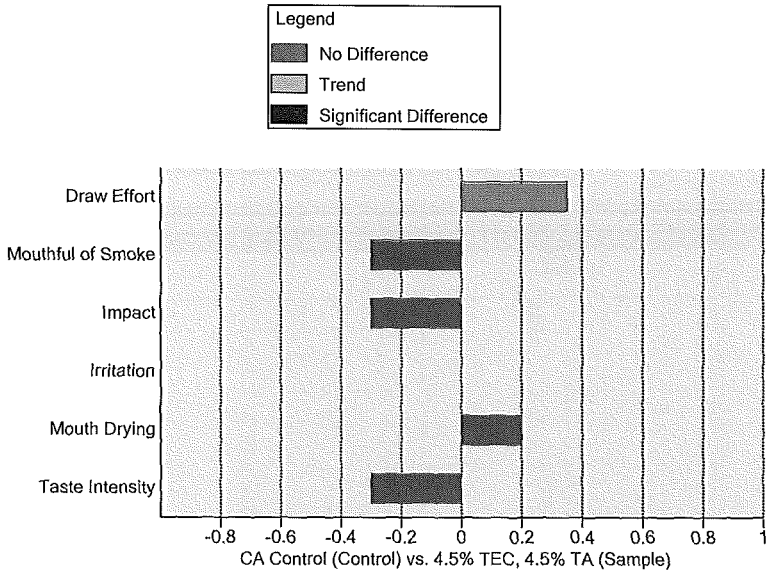

CA Control (Control 1) vs. Puracel™ with 4.5% TEC, 4.5% TA (Test 5)—see FIG. 2E There was not enough evidence to show a statistically significant difference between the control and the test sample in terms of Draw Effort at a 5% significance level, although there is some evidence at a 10% significance level.

Figure 2F:
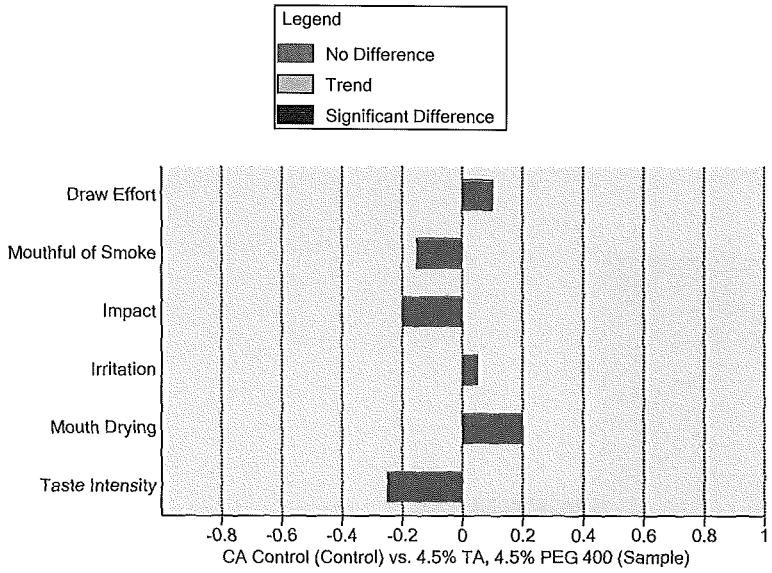

CA Control (Control 1) vs. Puracel™ with 4.5% TA, 4.5% PEG 400 (Test 6)—see FIG. 2F There was not enough evidence to show a statistically significant difference between the control and the test sample at a 5% significance level.

Figure 2G:
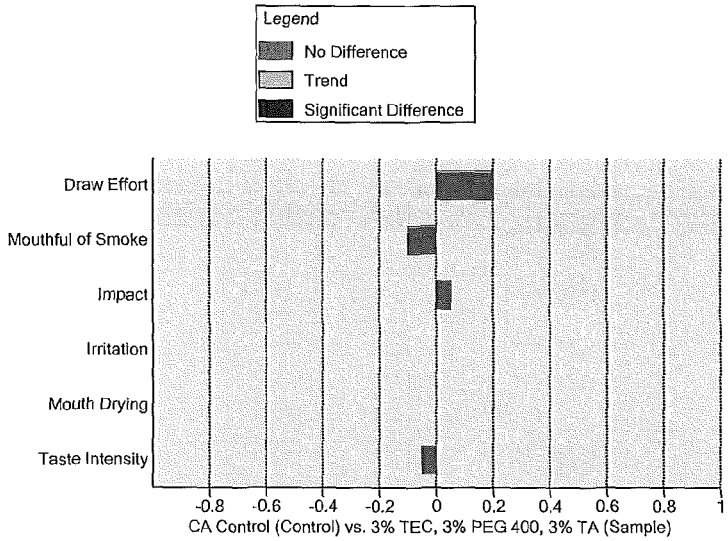

CA Control (Control 1) vs. Puracel™ with 3% TEC, 3% PEG 400, 3% TA (Test 7)—see FIG. 2G There was not enough evidence to show a statistically significant difference between the control and the test sample at a 5% significance level.

Conclusions

Based on the objective there were no significant differences between the CA control and three of the seven test samples, namely Test 1, Test 6, and Test 7.

Two samples showed there were directional trends without being significantly different to the CA control, namely Test 2 and Test 5, both of which showed Draw Effort to be directionally higher than the control.

Test 3 showed significant differences compared to the CA control on the mechanics with Mouthful of Smoke being lower than the control resulting in higher Draw Effort, with the strength attribute Impact and taste attribute Taste Intensity also being lower than the control Finally, Test 4 showed the biggest sensorial differences statistically; on the mechanics with Draw Effort being higher than the control resulting in Mouthful of Smoke being significantly lower than the control. Test 4 also showed the strength attributes Impact, Irritation and the taste attribute Taste Intensity was lower than the control.

EXAMPLE 3

The objective of this experiment was to determine the effect on biodegradability of the use of a paper filter material in the place of conventional cellulose acetate. To do this, degradation under environmental conditions was assessed for a control cellulose acetate filter and three test samples.

Control: cellulose acetate filter

Test 1: Puracel™ (7 mg) with no additive

Test 2: Puracel™ with 7% Triacetin

Test 3: Puracel™ with 7% PEG 400

Methodology

The following protocol was used for measuring the disintegration of smoked cigarette butts into non-recognizable component parts that are readily dispersible. Tests were conducted on grass and the butts were placed within stainless steel cages (45 cm×30 cm) with 6 sub-compartments per cage. When the grass was periodically cut, care was taken not to disturb the samples.

The test site was located in a well drained, open area away from tall buildings and trees. Interference from humans and animal activity was kept to a minimum by a perimeter fence around the test area.

For each sample a total of 100 cigarette butts were smoked to ISO standard (35 mL puff volume/2 seconds/every 60 seconds). After smoking, each butt was removed from the machine and the remaining tobacco and paper section removed by cutting back to the filter using a razor blade. This left the plug, plug wrap and tipping intact. The butts were then conditioned for 48 hours at 22° C.+/−1° C. and 60%+/−2% RH. 20 butts from each sample are weighed and the mean weight calculated.

After a period of 3 months sample butts were to be removed from each section of the cage. These butts were oven dried, reconditioned, weighed and photographed. The cigarette butts were dried in an oven at 105° C. for 3 hours. The dried butts were gently cleaned with soft tissue to remove dirt and plant matter. The cleaned butts were then conditioned for 48 hours at 22° C.+7-1° C. and 60%+/−2% RH. Five butts were weighed from each replicate. These weights are compared to the mean weight of five undegraded butts as calculated at the beginning of the test.

$$\text{Remaining weight (\%)} = \frac{\text{mass of 5 butts after weathering}}{\text{mass of 5 butts before weathering}} \times 100$$

Results

Figure 3:
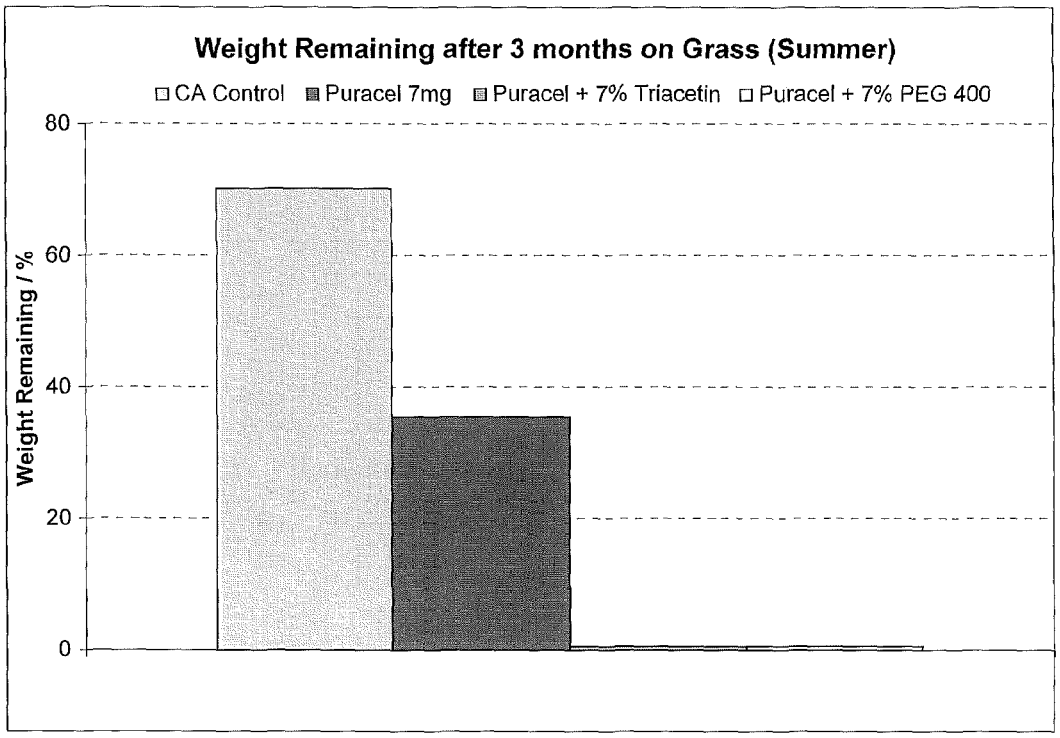
FIG. 3 illustrates results of an experiment testing biodegradability of various filter materials, according to some embodiments.

The results are shown in Table 1 below and are illustrated in the graph of FIG. 3.

TABLE 1

| Sample | Remaining weight after 3 months on grass surface (% of mean starting weight) |
|---|---|
| Control | 70.15 |
| Test 1 | 35.42 |
| Test 2 | 0 |
| Test 3 | 0 |

Unexpectedly, when the sample butts came to be assessed after 3 months, the test 2 and test 3 butts had disintegrated. Their weight was therefore 0% of the mean weight of the undegraded butts. In contrast, the remaining weight of the test 1 butts was just over 35%, and the remaining weight of the control cellulose acetate butts was just over 70% of the mean starting weight.

Conclusions

The results show that the use of a paper filter material (Puracel™) instead of conventional cellulose acetate had a significant effect on the rate of degradation under the test conditions, which was to be expected in view of the fact that the paper filter material is more readily biodegradable than plasticized cellulose acetate tow.

More surprisingly, the results also indicate that the addition of the additives triacetin and PEG to a paper filter material significantly increased the rate of biodegradation of the butts on a grass surface. It is speculated that this may have been due to the presence of microorganisms, insects and the like, which fed on the butts and the presence of the additives made the test 2 and test 3 butts more attractive. PEG, for example, is a fatty material which may have been recognised as providing the butts with improved nutritional value.

EXAMPLE 4

Four smoked samples were submitted for outdoor surface testing on three substrates: soil, concrete and grass. The sample IDs were as follows:

Puracel™ 7 mg
Puracel™+7% triacetin 7 mg
Puracel™+7% PEG 400 7 mg
CA Control

This method is for measuring the disintegration of smoked cigarette filters under "real" outside test conditions. At least 100 machine smoked filters per sample were required for each test surface. Each filter had the tobacco removed and the tipping paper trimmed back to the filter rod. The filters were conditioned to ISO standard 3402 and weighed and the mean of five filters was calculated. At least twenty filters were placed in each section of the cage (5 replicates×20 filters for each sample). Five filters per replicate were removed at time points specified in the request. Filters were dried, conditioned, cleaned, weighed and photographed at each time frame. Sample weights were then compared to the original unweathered samples.

Results

TABLE 2

| | | | Test Period (months) | | | |
|---|---|---|---|---|---|---|
| | | | 0 | 3 | 6 | 9 |
| Sample ID | Replicate | Surface | Weight remaining (%) | | | |
| Puracel ™ 7 mg | 1 | Soil | 100 | 93 | 85 | 80 |
| Puracel ™ 7 mg | 2 | Soil | 100 | 91 | 81 | 82 |
| Puracel ™ 7 mg | 3 | Soil | 100 | 94 | 82 | 68 |
| Puracel ™ 7 mg | 4 | Soil | 100 | 91 | 86 | 81 |
| Puracel ™ 7 mg | 5 | Soil | 100 | 92 | 90 | 73 |
| Puracel ™ + 7% triacetin 7 mg | 1 | Soil | 100 | 90 | 74 | 71 |
| Puracel ™ + 7% triacetin 7 mg | 2 | Soil | 100 | 91 | 90 | 51 |
| Puracel ™ + 7% triacetin 7 mg | 3 | Soil | 100 | 89 | 63 | 41 |
| Puracel ™ + 7% triacetin 7 mg | 4 | Soil | 100 | 90 | 65 | 35 |
| Puracel ™ + 7% triacetin 7 mg | 5 | Soil | 100 | 89 | 59 | 64 |
| Puracel ™ + 7% PEG 400 7 mg | 1 | Soil | 100 | 86 | 71 | 63 |
| Puracel ™ + 7% PEG 400 7 mg | 2 | Soil | 100 | 88 | 74 | 66 |
| Puracel ™ + 7% PEG 400 7 mg | 3 | Soil | 100 | 91 | 76 | 54 |
| Puracel ™ + 7% PEG 400 7 mg | 4 | Soil | 100 | 90 | 75 | 43 |
| Puracel ™ + 7% PEG 400 7 mg | 5 | Soil | 100 | 71 | 64 | 35 |
| CA Control | 1 | Soil | 100 | 90 | 72 | 76 |
| CA Control | 2 | Soil | 100 | 89 | 73 | 79 |
| CA Control | 3 | Soil | 100 | 86 | 75 | 89 |
| CA Control | 4 | Soil | 100 | 89 | 80 | 79 |
| CA Control | 5 | Soil | 100 | 88 | 80 | 75 |

TABLE 3

| | | | Test Period (months) | | | |
|---|---|---|---|---|---|---|
| | | | 0 | 3 | 6 | 9 |
| Sample ID | Replicate | Surface | Weight remaining (%) | | | |
| Puracel ™ 7 mg | 1 | Concrete | 100 | 89 | 81 | 70 |
| Puracel ™ 7 mg | 2 | Concrete | 100 | 87 | 83 | 75 |
| Puracel ™ 7 mg | 3 | Concrete | 100 | 94 | 80 | 73 |
| Puracel ™ 7 mg | 4 | Concrete | 100 | 92 | 89 | 77 |
| Puracel ™ 7 mg | 5 | Concrete | 100 | 91 | 84 | 78 |
| Puracel ™ + 7% triacetin 7 mg | 1 | Concrete | 100 | 91 | 90 | 81 |
| Puracel ™ + 7% triacetin 7 mg | 2 | Concrete | 100 | 90 | 91 | 78 |
| Puracel ™ + 7% triacetin 7 mg | 3 | Concrete | 100 | 90 | 86 | 82 |
| Puracel ™ + 7% triacetin 7 mg | 4 | Concrete | 100 | 92 | 87 | 84 |
| Puracel ™ + 7% triacetin 7 mg | 5 | Concrete | 100 | 91 | 87 | 82 |

TABLE 3-continued

| Sample ID | Replicate | Surface | Test Period (months) 0 | 3 | 6 | 9 |
|---|---|---|---|---|---|---|
| | | | Weight remaining (%) | | | |
| Puracel ™ + 7% PEG 400 7 mg | 1 | Concrete | 100 | 90 | 86 | 80 |
| Puracel ™ + 7% PEG 400 7 mg | 2 | Concrete | 100 | 90 | 88 | 71 |
| Puracel ™ + 7% PEG 400 7 mg | 3 | Concrete | 100 | 91 | 87 | 79 |
| Puracel ™ + 7% PEG 400 7 mg | 4 | Concrete | 100 | 88 | 84 | 76 |
| Puracel ™ + 7% PEG 400 7 mg | 5 | Concrete | 100 | 91 | 85 | 80 |
| CA Control | 1 | Concrete | 100 | 89 | 85 | 81 |
| CA Control | 2 | Concrete | 100 | 90 | 78 | 78 |
| CA Control | 3 | Concrete | 100 | 91 | 84 | 79 |
| CA Control | 4 | Concrete | 100 | 89 | 84 | 75 |
| CA Control | 5 | Concrete | 100 | 90 | 80 | 81 |

TABLE 4

| Sample ID | Replicate | Surface | Test Period (months) 0 | 3 | 6 | 9 |
|---|---|---|---|---|---|---|
| | | | Weight remaining (%) | | | |
| Puracel ™ 7 mg | 1 | Grass | 100 | 0 | 0 | 0 |
| Puracel ™ 7 mg | 2 | Grass | 100 | 48 | 0 | 0 |
| Puracel ™ 7 mg | 3 | Grass | 100 | 25 | 0 | 0 |
| Puracel ™ 7 mg | 4 | Grass | 100 | 69 | 0 | 0 |
| Puracel ™ 7 mg | 5 | Grass | 100 | 35 | 0 | 0 |
| Puracel ™ + 7% triacetin 7 mg | 1 | Grass | 100 | 0 | 0 | 0 |
| Puracel ™ + 7% triacetin 7 mg | 2 | Grass | 100 | 0 | 0 | 0 |
| Puracel ™ + 7% triacetin 7 mg | 3 | Grass | 100 | 0 | 0 | 0 |
| Puracel ™ + 7% triacetin 7 mg | 4 | Grass | 100 | 0 | 0 | 0 |
| Puracel ™ + 7% triacetin 7 mg | 5 | Grass | 100 | 0 | 0 | 0 |
| Puracel ™ + 7% PEG 400 7 mg | 1 | Grass | 100 | 0 | 0 | 0 |

TABLE 4-continued

| Sample ID | Replicate | Surface | Test Period (months) 0 | 3 | 6 | 9 |
|---|---|---|---|---|---|---|
| | | | Weight remaining (%) | | | |
| Puracel ™ + 7% PEG 400 7 mg | 2 | Grass | 100 | 0 | 0 | 0 |
| Puracel ™ + 7% PEG 400 7 mg | 3 | Grass | 100 | 0 | 0 | 0 |
| Puracel ™ + 7% PEG 400 7 mg | 4 | Grass | 100 | 0 | 0 | 0 |
| Puracel ™ + 7% PEG 400 7 mg | 5 | Grass | 100 | 0 | 0 | 0 |
| CA Control | 1 | Grass | 100 | 73 | 65 | 69 |
| CA Control | 2 | Grass | 100 | 68 | 68 | 73 |
| CA Control | 3 | Grass | 100 | 72 | 69 | 68 |
| CA Control | 4 | Grass | 100 | 70 | 70 | 70 |
| CA Control | 5 | Grass | 100 | 68 | 70 | 70 |

Where 0% is entered this means that no recognisable filter material could be found on the substrate. Any apparent weight increases can be attributable to particles of dirt being caught up in the filters can which could not be removed by cleaning.

EXAMPLE 5

Various characteristics of sample filters according to the present invention were assessed and the data is set out in Tables 5 to 18 below. The filter samples are the same as those used in Example 2, with the Control being a conventional "Parisienne" CA filter, Test 1 being filter material comprising Puracel™ with 0% Plasticiser, Test 2 being Puracel™ with 9% TEC, Test 3 being Puracel™ with 9% TA, Test 4 being Puracel™ with 4.5% TEC, 4.5% PEG, Test 5 being Puracel™ with 4.5% TEC, 4.5% TA, Test 6 being Puracel™ with 4.5% TA, 4.5% PEG 400 and Test 7 being Puracel™ with 3% TEC, 3% PEG 400, 3% TA.

Routine smoke and physical data are set out in Tables 5 to 8. The smoke analyte data for the test filter material and the control is set out in Tables 9 to 13. The standard deviation for these measured analytes is set our in Tables 14 to 18.

The cigarettes were smoked according to the standard ISO smoking regime (35 mL puff volume/2 seconds/every 60 seconds).

TABLE 5

| Filter | Fixed Butt Length (mm) | Mean TPM (mg/cig) | Mean Water (mg/cig) | Mean Nicotine (mg/cig) | Mean NFDPM (mg/cig) | Mean Puff No. | Mean CO (mg/cig) | Mean % Tip Ventilation |
|---|---|---|---|---|---|---|---|---|
| Test 7 | 30 | 7.3 | 0.5 | 0.50 | 6.4 | 8.8 | 6.0 | 45.21 |
| Test 5 | 30 | 7.7 | 0.5 | 0.53 | 6.7 | 8.8 | 6.2 | 46.52 |
| Test 4 | 30 | 7.0 | 0.6 | 0.47 | 6.0 | 8.6 | 6.3 | 46.45 |
| Test 3 | 30 | 7.3 | 0.5 | 0.54 | 6.2 | 8.3 | 6.3 | 45.03 |
| Test 2 | 30 | 6.6 | 0.5 | 0.49 | 5.7 | 8.6 | 6.3 | 45.63 |
| Test 6 | 30 | 7.8 | 0.7 | 0.56 | 6.6 | 8.9 | 6.3 | 46.23 |
| Test 1 | 29 | 7.8 | 0.6 | 0.55 | 6.6 | 8.8 | 6.3 | 44.78 |
| Control | 30 | 8.1 | 0.4 | 0.60 | 7.1 | 8.4 | 6.1 | 45.2 |

TABLE 6

| Filter | Mean Paper Permeability (Coresta units) | Mean Filter Length (mm) | Mean Total PD Vents Open (mm WG) | Mean Total PD Vents Closed (mm WG) | Mean Filter PD Vents Closed (mmWG) | Calc. Tobacco Rod Length (mm) | Mean Total Cigarette Weight (mg) | Mean Circumference (mm) | Calc. Tobacco Weight (mg) (Corrected for moisture) |
|---|---|---|---|---|---|---|---|---|---|
| Test 7 | 51.7 | 22 | 69.1 | 108.1 | 58.4 | 61 | 920 | 24.62 | 680.6 |
| Test 5 | 57 | 22 | 67.6 | 107.9 | 55.2 | 61.4 | 931.4 | 24.59 | 668.49 |
| Test 4 | 55.6 | 22 | 72.1 | 113.8 | 61.1 | 61 | 928.6 | 24.57 | 686.57 |
| Test 3 | 55.2 | 22 | 68.2 | 107.7 | 55.2 | 61 | 921.1 | 24.58 | 685.74 |
| Test 2 | 51.9 | 22 | 68.8 | 109.7 | 55.2 | 61 | 933.6 | 24.5 | 691.89 |
| Test 6 | 53.4 | 22 | 68.1 | 109.4 | 52.7 | 61 | 942.2 | 24.64 | 700.29 |

TABLE 6-continued

| Filter | Mean Paper Permeability (Coresta units) | Mean Filter Length (mm) | Mean Total PD Vents Open (mm WG) | Mean Total PD Vents Closed (mm WG) | Mean Filter PD Vents Closed (mmWG) | Calc. Tobacco Rod Length (mm) | Mean Total Cigarette Weight (mg) | Mean Circumference (mm) | Calc. Tobacco Weight (mg) (Corrected for moisture) |
|---|---|---|---|---|---|---|---|---|---|
| Test 1 | 53.7 | 21 | 69.7 | 109.7 | 55.4 | 62 | 917.7 | 24.56 | 690.8 |
| Control | 57.4 | 22 | 81.1 | 122.4 | 67.4 | 61 | 882.3 | 24.63 | 682.5 |

TABLE 7

| Filter | SD TPM (mg/cig) | SD Water (mg/cig) | SD Nicotine (mg/cig) | SD NFDPM (mg/cig) | SD Puff No. | SD CO (mg/cig) |
|---|---|---|---|---|---|---|
| Test 7 | 0.30 | 0.11 | 0.02 | 0.21 | 0.2 | 0.37 |
| Test 5 | 0.45 | 0.13 | 0.03 | 0.31 | 0.3 | 0.35 |
| Test 4 | 0.40 | 0.11 | 0.02 | 0.27 | 0.2 | 0.24 |
| Test 3 | 0.45 | 0.05 | 0.02 | 0.43 | 0.1 | 0.28 |
| Test 2 | 0.44 | 0.09 | 0.03 | 0.38 | 0.3 | 0.45 |

TABLE 7-continued

| Filter | SD TPM (mg/cig) | SD Water (mg/cig) | SD Nicotine (mg/cig) | SD NFDPM (mg/cig) | SD Puff No. | SD CO (mg/cig) |
|---|---|---|---|---|---|---|
| Test 6 | 0.11 | 0.35 | 0.02 | 0.42 | 0.1 | 0.37 |
| Test 1 | 0.70 | 0.16 | 0.04 | 0.52 | 0.3 | 0.35 |
| Control | 0.34 | 0.24 | 0.02 | 0.42 | 0.1 | 0.20 |

TABLE 8

| Filter | SD % Tip Ventilation | SD Paper Permeability (Coresta units) | SD Filter Length (mm) | SD Total PD Vents Open (mm WG) | SD Total PD Vents Closed (mm WG) | SD Filter PD Vents Closed (mm WG) | SD Total Weight (mg) | SD Circumference (mm) |
|---|---|---|---|---|---|---|---|---|
| Test 7 | 1.65 | 3.60 | NR | 2.4 | 6.3 | 3.2 | 26.5 | 0.08 |
| Test 5 | 1.33 | 6.05 | NR | 3.0 | 5.5 | 3.2 | 26.6 | 0.06 |
| Test 4 | 2.84 | 4.03 | NR | 2.9 | 6.0 | 2.8 | 26.8 | 0.05 |
| Test 3 | 2.67 | 4.91 | NR | 2.8 | 6.9 | 1.9 | 27.4 | 0.06 |
| Test 2 | 1.86 | 5.63 | NR | 2.3 | 5.9 | 2.9 | 23.0 | 0.06 |
| Test 6 | 1.52 | 1.84 | NR | 2.8 | 6.2 | 3.1 | 27.3 | 0.08 |
| Test 1 | 1.61 | 5.74 | NR | 2.5 | 6.3 | 1.6 | 29.5 | 0.06 |
| Control | 1.49 | 5.72 | NR | 2.7 | 4.9 | 3.0 | 31.3 | 0.06 |

TABLE 9

| Filter | Mean Ammonia (μg/cig) | Mean 1-Aminonaphthalene (ng/cig) | Mean 2-Aminonaphthalene (ng/cig) | Mean 3-Aminobiphenyl (ng/cig) | Mean 4-Aminobiphenyl (ng/cig) | Mean Benzo(a)pyrene (ng/cig) | Mean Acetaldehyde (μg/cig) |
|---|---|---|---|---|---|---|---|
| Test 7 | 4.66 | 8.08 | 7.30 | 1.55 | 1.2 | 7.11 | 355 |
| Test 5 | 4.75 | 8.04 | 7.35 | 1.54 | 1.23 | 7.21 | 336 |
| Test 4 | 4.92 | 7.99 | 7.10 | 1.48 | 1.2 | 7.49 | 330 |
| Test 3 | 5.41 | 7.06 | 5.82 | 1.37 | 1.17 | 8.70 | 352 |
| Test 2 | 5.17 | 7.09 | 5.77 | 1.34 | 1.13 | 8.25 | 337 |
| Test 6 | 5.76 | 7.72 | 6.72 | 1.45 | 1.23 | 8.48 | 350 |
| Test 1 | 4.44 | 8.11 | 6.98 | 1.45 | 1.16 | 7.08 | 350 |
| Control | 6.56 | 10.5 | 8.48 | 1.91 | 1.47 | 8.78 | 331 |

TABLE 10

| Filter | Mean Acetone (μg/cig) | Mean Acrolein (μg/cig) | Mean Butyraldehyde (μg/cig) | Mean Crotonaldehyde (μg/cig) | Mean Formaldehyde (μg/cig) | Mean Methyl Ethyl Ketone (μg/cig) | Mean Propionaldehyde (μg/cig) | Mean Hydrogen Cyanide (μg/cig) | Mean Arsenic (ng/cig) |
|---|---|---|---|---|---|---|---|---|---|
| Test 7 | 193 | 38.7 | 24.3 | 9.73 | 13.2 | 45.8 | 32.3 | 59.7 | 1.71 |
| Test 5 | 181 | 34.7 | 22.8 | 9.50 | 11.2 | 43.1 | 30.6 | 59.0 | 2.68 |
| Test 4 | 181 | 35.2 | 24.1 | 8.72 | 11.0 | 45.4 | 30.3 | 56.4 | 1.14 |
| Test 3 | 197 | 38.7 | 26.1 | 9.58 | 12.6 | 49.8 | 32.7 | 61.8 | 1.14 |
| Test 2 | 184 | 34.9 | 24.0 | 8.65 | 11.3 | 45.1 | 30.8 | 62.9 | 1.14 |
| Test 6 | 192 | 37.5 | 25.5 | 9.83 | 11.8 | 48.6 | 32.4 | 58.0 | 1.04 |
| Test 1 | 198 | 38.0 | 24.8 | 10.6 | 10.9 | 48.7 | 32.6 | 58.0 | 1.44 |
| Control | 178 | 34.6 | 22.6 | 7.42 | 13.1 | 42.7 | 31.0 | 51.4 | 2.49 |

TABLE 11

| Filter | Mean Cadmium (ng/cig) | Mean Chromium (ng/cig) | Mean Lead (ng/cig) | Mean Mercury (ng/cig) | Mean Nickel (ng/cig) | Mean Selenium (ng/cig) | Mean Nitrogen Oxide (μg/cig) | Mean Catechol (μg/cig) | Mean Hydroquinone (μg/cig) |
|---|---|---|---|---|---|---|---|---|---|
| Test 7 | 13.3 | ≤1.17 | ≤12.03 | ≤0.13 | ≤1.99 | ≤4.1 | 98.4 | 39.5 | 40.3 |
| Test 5 | 13.4 | ≤1.17 | ≤12.03 | ≤0.13 | ≤1.99 | ≤4.1 | 103 | 38.7 | 38.5 |
| Test 4 | 11.7 | ≤1.17 | ≤12.03 | ≤0.13 | ≤1.99 | ≤4.1 | 99.6 | 37.9 | 38.5 |
| Test 3 | 14.7 | ≤1.17 | ≤12.03 | ≤0.13 | ≤1.99 | ≤4.1 | 102 | 42.3 | 41.8 |
| Test 2 | 13.5 | ≤1.17 | ≤12.03 | ≤0.13 | ≤1.99 | ≤4.1 | 102 | 37.7 | 37.6 |
| Test 6 | 13.5 | ≤1.17 | ≤12.03 | ≤0.13 | ≤1.99 | ≤4.1 | 96.1 | 41.8 | 42.5 |
| Test 1 | 12.5 | ≤1.17 | ≤12.03 | ≤0.13 | ≤1.99 | ≤4.1 | 107 | 37.0 | 37.0 |
| Control | 13.3 | ≤1.17 | ≤12.03 | ≤0.13 | ≤1.99 | ≤4.1 | 112 | 42.3 | 43.4 |

TABLE 12

| Filter | Mean Phenol (μg/cig) | Mean Resorcinol (μg/cig) | Mean m-Cresol (μg/cig) | Mean o-Cresol (μg/cig) | Mean p-Cresol (μg/cig) | Mean Pyridine (μg/cig) | Mean Quinoline (μg/cig) | Mean Styrene (μg/cig) | Mean NAB (ng/cig) |
|---|---|---|---|---|---|---|---|---|---|
| Test 7 | 11.3 | 0.92 | 2.48 | 3.04 | 5.98 | 5.26 | 0.214 | 5.51 | 5.84 |
| Test 5 | 9.85 | 0.91 | 2.13 | 2.46 | 5.15 | 5.46 | 0.178 | 4.76 | 6.02 |
| Test 4 | 9.14 | 0.90 | 2.12 | 2.53 | 5.17 | 4.40 | 0.180 | 5.05 | 6.14 |
| Test 3 | 16.3 | 0.96 | 3.22 | 4.18 | 7.85 | 7.11 | 0.270 | 5.98 | 6.59 |
| Test 2 | 10.4 | 0.88 | 2.18 | 2.57 | 5.28 | 6.18 | 0.180 | 5.54 | 5.99 |
| Test 6 | 12.9 | 0.98 | 2.84 | 3.64 | 6.89 | 6.93 | 0.277 | 6.2 | 7.32 |
| Test 1 | 17.4 | 0.86 | 3.36 | 4.59 | 8.08 | 7.93 | 0.330 | 6.29 | 5.74 |
| Control | 7.89 | 1.02 | 2.02 | 2.32 | 4.82 | 4.30 | 0.170 | 4.64 | 7.10 |

TABLE 13

| Filter | Mean NAT (ng/cig) | Mean NNK (ng/cig) | Mean NNN (ng/cig) | Mean 1,3 Butadiene (μg/cig) | Mean Acrylonitrile (μg/cig) | Mean Benzene (μg/cig) | Mean Isoprene (μg/cig) | Mean Toluene (μg/cig) |
|---|---|---|---|---|---|---|---|---|
| Test 7 | 42.4 | 24.7 | 51.5 | 39.4 | 10.3 | 39.3 | 353 | 56.5 |
| Test 5 | 42.3 | 24.9 | 50.8 | 38.8 | 9.78 | 38.5 | 351 | 57.8 |
| Test 4 | 47.7 | 24.8 | 54.6 | 34.7 | 9.20 | 36.4 | 316 | 57.5 |
| Test 3 | 48.0 | 26.0 | 56.6 | 38.1 | 10.6 | 40.8 | 347 | 64.4 |
| Test 2 | 43.1 | 26.8 | 53.6 | 38.7 | 10.4 | 40.4 | 352 | 63.9 |
| Test 6 | 50.7 | 29.7 | 61.4 | 45.6 | 11.3 | 46.4 | 418 | 64.8 |
| Test 1 | 41.1 | 24.9 | 49.7 | 36.4 | 9.99 | 39.3 | 328 | 59.2 |
| Control | 51.4 | 30.1 | 60.24 | 39.3 | 9.90 | 42.6 | 356 | 67.1 |

TABLE 14

| Filter | SD Ammonia | SD Acetone | SD 1-Aminonaphthalene | SD 2-Aminonaphthalene | SD 3-Aminobiphenyl | SD 4-Aminobiphenyl | SD Benzo(a)pyrene | SD Acetaldehyde |
|---|---|---|---|---|---|---|---|---|
| Test 7 | 0.48 | 15.8 | 0.25 | 0.48 | 0.06 | 0.04 | 0.07 | 30.9 |
| Test 5 | 0.49 | 8.1 | 0.60 | 0.72 | 0.13 | 0.04 | 0.26 | 20.9 |
| Test 4 | 0.46 | 26.0 | 0.62 | 1.07 | 0.09 | 0.07 | 0.77 | 41.1 |
| Test 3 | 0.56 | 29.0 | 0.38 | 0.53 | 0.10 | 0.08 | 0.35 | 51.2 |
| Test 2 | 0.83 | 14.1 | 0.41 | 0.33 | 0.07 | 0.04 | 0.81 | 21.7 |
| Test 6 | 0.47 | 20.7 | 0.28 | 0.39 | 0.04 | 0.04 | 0.66 | 45.0 |
| Test 1 | 0.51 | 9.3 | 0.33 | 0.28 | 0.13 | 0.03 | 0.23 | 12.0 |
| Control | 0.77 | 12.3 | 0.46 | 0.61 | 0.11 | 0.09 | 0.46 | 19.6 |

TABLE 15

| Filter | SD Acrolein | SD Butyraldehyde | SD Crotonaldehyde | SD Formaldehyde | SD Methyl Ethyl Ketone | SD Propionaldehyde | SD Hydrogen Cyanide | SD Arsenic | SD Cadmium | SD Chromium |
|---|---|---|---|---|---|---|---|---|---|---|
| Test 7 | 5.5 | 2.0 | 1.5 | 2.4 | 4.6 | 3.4 | 4.0 | 0.58 | 1.8 | NA |
| Test 5 | 3.4 | 1.6 | 1.1 | 1.5 | 2.0 | 1.8 | 3.2 | 2.01 | 2.8 | NA |
| Test 4 | 5.0 | 3.4 | 2.3 | 1.8 | 6.5 | 3.8 | 3.1 | 0.14 | 1.2 | NA |
| Test 3 | 6.2 | 4.3 | 2.4 | 3.2 | 7.9 | 5.1 | 8.0 | 0.14 | 2.2 | NA |
| Test 2 | 2.8 | 2.1 | 1.1 | 1.7 | 3.9 | 2.1 | 2.4 | 0.01 | 3.1 | NA |
| Test 6 | 6.7 | 2.6 | 1.2 | 2.5 | 4.6 | 3.8 | 2.7 | 0.05 | 0.4 | NA |
| Test 1 | 2.6 | 1.0 | 0.6 | 0.5 | 3.1 | 1.4 | 7.5 | 0.19 | 1.9 | NA |
| Control | 1.8 | 1.4 | 0.6 | 0.7 | 3.0 | 1.8 | 2.9 | 0.58 | 0.8 | NA |

TABLE 16

| Filter | SD Lead | SD Mercury | SD Nickel | SD Selenium | SD Nitrogen Oxide | SD Catechol | SD Hydroquinone | SD Phenol | SD Resorcinol | SD m-Cresol |
|---|---|---|---|---|---|---|---|---|---|---|
| Test 7 | NA | NA | NA | NA | 8.4 | 2.0 | 1.9 | 0.90 | 0.02 | 0.19 |
| Test 5 | NA | NA | NA | NA | 3.63 | 1.5 | 1.1 | 0.84 | 0.04 | 0.15 |
| Test 4 | NA | NA | NA | NA | 3.75 | 4.8 | 5.2 | 1.34 | 0.10 | 0.29 |
| Test 3 | NA | NA | NA | NA | 3.97 | 5.3 | 4.6 | 2.01 | 0.10 | 0.38 |
| Test 2 | NA | NA | NA | NA | 7.77 | 2.0 | 1.8 | 0.89 | 0.03 | 0.19 |
| Test 6 | NA | NA | NA | NA | 3.9 | 5.1 | 5.1 | 1.87 | 0.11 | 0.38 |
| Test 1 | NA | NA | NA | NA | 1.83 | 2.3 | 2.4 | 1.21 | 0.04 | 0.27 |
| Control | NA | NA | NA | NA | 1.38 | 1.3 | 1.7 | 0.47 | 0.03 | 0.13 |

TABLE 17

| Filter | SD o-Cresol | SD p-Cresol | SD Pyridine | SD Quinoline | SD Styrene | SD NAB | SD NAT | SD NNK | SD NNN | SD 1,3 Butadiene |
|---|---|---|---|---|---|---|---|---|---|---|
| Test 7 | 0.26 | 0.45 | 0.59 | 0.02 | 0.4 | 0.69 | 4.7 | 4.1 | 5.3 | 3.0 |
| Test 5 | 0.21 | 0.41 | 0.74 | 0.01 | 0.39 | 0.33 | 1.8 | 2.1 | 1.9 | 6.7 |
| Test 4 | 0.35 | 0.64 | 0.53 | 0.01 | 0.49 | 0.28 | 6.1 | 1.9 | 3.1 | 2.6 |
| Test 3 | 0.51 | 1.00 | 0.51 | 0.03 | 0.34 | 0.67 | 5.0 | 3.3 | 7.3 | 5.7 |
| Test 2 | 0.21 | 0.36 | 1.30 | 0.03 | 0.54 | 0.64 | 5.3 | 2.1 | 8.0 | 2.7 |
| Test 6 | 0.52 | 0.98 | 0.64 | 0.02 | 0.55 | 0.7 | 4.9 | 9.3 | 3.3 | 5.4 |
| Test 1 | 0.38 | 0.53 | 0.63 | 0.01 | 0.36 | 0.49 | 2.6 | 2.9 | 6.2 | 1.7 |
| Control | 0.14 | 0.26 | 0.30 | 0.01 | 0.23 | 0.30 | 2.3 | 3.7 | 2.8 | 2.5 |

TABLE 18

| Filter | SD Acrylonitrile | SD Benzene | SD Isoprene | SD Toluene |
|---|---|---|---|---|
| Test 7 | 0.5 | 1.6 | 27 | 2.2 |
| Test 5 | 1.5 | 5.5 | 60 | 7.8 |
| Test 4 | 0.8 | 2.5 | 22 | 4.2 |
| Test 3 | 1.4 | 5.9 | 48 | 8.5 |
| Test 2 | 0.8 | 2.6 | 23 | 4.6 |
| Test 6 | 2.3 | 6.3 | 52 | 12.0 |
| Test 1 | 0.5 | 1.4 | 12 | 1.5 |
| Control | 0.5 | 2.4 | 25 | 4.3 |

The examples demonstrate that at least some of the test filters according to the present invention are more readily degradable than filter elements comprising a conventional cellulose acetate filter material, they exhibits good selective removal of semi-volatile compounds and provide smoke having similar taste characteristics to that provided by conventional cellulose acetate filters.

All publications mentioned in the above specification are herein incorporated by reference. Various modifications and variations of the described methods and system of the present invention will be apparent to those skilled in the art without departing from the scope of the present invention. Although the present invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

The invention claimed is:

1. A smoking article filter element, comprising:

filter material which is a non-woven sheet or paper material;

polyethylene glycol in an amount sufficient to increase selective removal of semivolatile compounds from smoke being drawn through the filter element; and at least one of:

triethyl citrate in an amount sufficient to improve taste characteristics of smoke drawn through the filter element; and triacetin in an amount sufficient to improve the taste characteristics of smoke drawn through the filter element, wherein the filter material does not include cellulose acetate.

2. The filter element as claimed in claim 1, wherein the filter material is a gathered or pleated paper.

3. The filter element as claimed in claim 1, wherein the polyethylene glycol is a high molecular weight polyethylene glycol which is solid at room temperature.

4. The filter element as claimed in claim 1, wherein the polyethylene glycol is PEG 1000.

5. The filter element as claimed in claim 1, wherein the polyethylene glycol is included in the filter element in an amount of up to 30% by weight of the filter element.

6. The filter element as claimed in claim 1, wherein the at least one of triacetin and triethyl citrate is included in the filter element in an amount of up to 30% by weight of the filter element.

7. The filter element as claimed in claim 6, wherein the at least one of triacetin and triethyl citrate is included in the filter element in an amount of up to 20% by weight of the filter element.

8. The filter element as claimed in claim 1, further comprising at least one adsorbent material.

9. The filter element as claimed in claim 1, further comprising at least one additive comprising tobacco extracts, glycerine, flavourants, carbon particles and carbon fibres.

10. A smoking article filter comprising a filter element, said filter element comprising:

filter material which is a non-woven sheet or paper material;

polyethylene glycol in an amount sufficient to increase selective removal of semivolatile compounds from smoke being drawn through the filter element; and at least one of:

triethyl citrate in an amount sufficient to improve taste characteristics of smoke drawn through the filter element; and triacetin in an amount sufficient to improve the taste characteristics of smoke drawn through the filter element, wherein the filter material does not include cellulose acetate.

11. A smoking article comprising a rod of smokeable filler material and a filter element, said filter element comprising:

filter material which is a non-woven sheet or paper material;

polyethylene glycol in an amount sufficient to increase selective removal of semivolatile compounds from smoke being drawn through the filter element; and at least one of:

triethyl citrate in an amount sufficient to improve taste characteristics of smoke drawn through the filter element; and triacetin in an amount sufficient to improve the taste characteristics of smoke drawn through the filter element, wherein the filter material does not include cellulose acetate.

12. The smoking article as claimed in claim 11, wherein the smokeable filler material comprises tobacco.

13. The filter element as claimed in claim 1, wherein the filter material is a non-woven sheet material comprising at least one of polyvinyl alcohol, polyactic acid or polyactide, poly(ϵ-caprolactone), poly(1-4 butanediol succunate), and poly(butylene adipate-co-terephthalate), starch fibres and calcium alginate.

14. A smoking article comprising a rod of smokeable filler material and a filter comprising a filter element, said filter element for use in a smoking article, comprising:

filter material which is a non-woven sheet or paper material;

polyethylene glycol in an amount sufficient to increase selective removal of semivolatile compounds from smoke being drawn through the filter element; and at least one of:

triethyl citrate in an amount sufficient to improve taste characteristics of smoke drawn through the filter element; and triacetin in an amount sufficient to improve the taste characteristics of smoke drawn through the filter element, wherein the filter material does not include cellulose acetate.

* * * * *